United States Patent [19]

Hauser et al.

[11] Patent Number: 4,996,425

[45] Date of Patent: Feb. 26, 1991

[54] METHOD AND APPARATUS FOR INCREASING CORONA EFFICIENCY IN AN IONOGRAPHIC IMAGING DEVICE

[75] Inventors: Oscar G. Hauser, Rochester; Robert W. Anderson, Fairport; Lawrence M. Hart, Ontario, all of N.Y.

[73] Assignee: Xerox Corporation, Stamford, Conn.

[21] Appl. No.: 391,742

[22] Filed: Aug. 10, 1989

[51] Int. Cl.[5] ..... H01T 19/00

[52] U.S. Cl. ..... 250/325; 250/326; 346/159

[58] Field of Search ..... 250/325, 326; 346/155, 346/159; 361/225

[56] References Cited

U.S. PATENT DOCUMENTS

| | | | |
|---|---|---|---|
| 3,742,237 | 6/1973 | Parker | 250/324 |
| 4,053,769 | 10/1977 | Nishikawa et al. | 250/324 |
| 4,088,892 | 5/1978 | Plumadore | 250/325 |
| 4,112,299 | 9/1978 | Davis | 250/326 |
| 4,463,363 | 7/1984 | Gundlach et al. | 346/159 |
| 4,524,371 | 6/1985 | Sheridon et al. | 346/159 |
| 4,538,163 | 8/1985 | Sheridon | 346/155 |
| 4,575,216 | 3/1986 | Hebert et al. | 355/3 TR |
| 4,585,320 | 4/1986 | Altavela et al. | 355/3 CH |
| 4,644,373 | 2/1987 | Sheridan et al. | 346/159 |
| 4,737,805 | 4/1988 | Weisfield et al. | 346/159 |
| 4,743,925 | 5/1988 | Sheridon et al. | 346/159 |

*Primary Examiner*—Bruce C. Anderson

*Attorney, Agent, or Firm*—Mark Costello

[57] ABSTRACT

In an ionographic device projecting a modulated stream of ions in imagewise fashion towards a moving imaging surface, including an ion printing head having an ion chamber supporting a coronode held at a voltage $V_C$ to produce ions for deposit on an imaging surface and a modulation channel extending from the ion chamber towards the imaging surface through which a stream of ions is directed for imagewise modulation by a plurality of modulation electrodes, electric field distribution within the ion chamber is controlled by selectively varying voltages along the surface regions of the ion chamber to different voltage levels, in an arrangement causing focusing of ion density in the area of the ion chamber adjacent to the modulation channel. An increased ion density in the area of the ion chamber adjacent to the modulation channel assists in providing an increased corona current at the output of the device.

19 Claims, 5 Drawing Sheets

METHOD AND APPARATUS FOR INCREASING CORONA EFFICIENCY IN AN IONOGRAPHIC IMAGING DEVICE

The present invention relates generally to ionographic imaging devices, and more particularly to enhancing the efficiency of ion projection by increasing the corona current available for entrainment for use in the ion printing process.

INCORPORATION BY REFERENCE

U.S. Pat. No. 4,524,371 to Sheridon et al., U.S. Pat. No. 4,463,363 to Gundlach et al., U.S. Pat. No. 4,538,163 to Sheridon, U.S. Pat. No. 4,644,373 to Sheridon et al., U.S. Pat. No. 4,737,805 to Weisfield et al. and U.S. Pat. No. 4,112,299 to Davis.

BACKGROUND OF THE INVENTION

In ionographic imaging devices such as that described by U.S. Pat. No. 4,524,371 to Sheridon et al. or U.S. Pat. No. 4,463,363 to Gundlach et al., an ion producing device generates ions to be directed past a plurality of modulation electrodes to an imaging surface in imagewise configuration. In one class of ionographic devices, ions are produced at a coronode supported within an ion chamber, and a moving fluid stream entrains and carries ions produced at the coronode out of the chamber. At the chamber exit, a plurality of control electrodes or nibs are modulated with a control voltage to selectively control passage of ions through the chamber exit. Ions directed through the chamber exit are deposited on a charge retentive surface in imagewise configuration to form an electrostatic latent image developable by electrostatographic techniques for subsequent transfer to a final substrate. The arrangement produces a high resolution non-contact printing system. Other ionographic devices exist which operate similarly, but do not rely on a moving fluid stream to carry ions to a surface.

Corona efficiency in ionographic heads is very low, on the order of 0.1% to 0.5%, when efficiency is defined as the ratio of the current reaching the electroreceptor to the total current within the corona chamber. The entrainment process is inefficient because ions generated tend to follow the electric field lines, while entrainment depends upon molecular collisions. Space charge, which builds up within the ion chamber and the modulation channel, serves to limit the corona. This can be overcome by increasing air flow velocity through the head. One disadvantage of this method of improving corona efficiency is the increasing machine noise accompanying increased air flow. Dirt management and the high cost of the larger capacity air flow devices are other problems. Another method of increasing corona efficiency is to displace the coronode toward the exit channel. This utilizes geometrically non-uniform electric fields within the ion chamber to help guide the ions towards the exit channel. Thus, space charge will accumulate nonuniformly, and a greater part of the corona current entrained in the air flow will proceed through the modulation channel than with a coronode centrally located in the ion chamber. A disadvantage of this method is that corona output current is very sensitive to the coronode location and both spatial and temporal displacement from the "sweet" spot can cause variation in output current. Temporal displacement is the result of wire vibrations within the ion chamber, while spatial displacement results from tolerance stack up in the design of the wire mounting hardware.

Control of ion generation efficiency within corona devices for applying uniform charge to an imaging surface is known, for example, by U.S. Pat. No. 4,112,299 to Davis which shows a corona device with a shield formed from a plurality of conducting segments insulated from each other and biased to different potentials relative to the coronode, so that the distribution of charge from the corona device may be controlled by changing the bias arrangement, instead of requiring a device specifically designed for a particular requirement. U.S. Pat. No. 4,053,769 to Nishikawa et al. shows a corona device with a pair of insulating dielectric plates disposed in partially enclosing relationship across the corona device opening. U.S. Pat. No. 4,585,320 to Altavela et al. shows a corona device with a conductive shield grounded to increase the ion density for conduction. U.S. Pat. No. 3,742,237 to Parker suggests that an increase in the current flow from an A.C. corona device may be obtained by arranging a dielectric surface partially surrounding the coronode. U.S. Pat. No. 4,575,216 to Herbert et al. shows a dielectric ion shield extending from a point adjacent to a corona device to a point close to the entry of a paper sheet to a transfer station.

SUMMARY OF THE INVENTION

In accordance with the invention, in an ionographic head, there is provided a method and apparatus for controlling electric field distribution within an ion chamber therein, to increase ion density within the chamber in a region adjacent the modulation channel for increased ion entrainment at the channel, whereby corona current output from the head is increased.

In accordance with one aspect of the invention, in an ionographic device including a head projecting a modulated stream of ions in imagewise fashion towards a moving imaging surface, wherein the head is provided with an ion chamber supporting a coronode held at a voltage $V_C$ to produce ions for deposit on an imaging surface and a modulation channel extending from the ion chamber towards the imaging surface through which a stream of ions is directed for imagewise modulation by a plurality of modulation electrodes, electric field distribution within the ion chamber is controlled by selectively biasing regions of the head structure that form the chamber at different voltage levels, in an arrangement causing the focusing of ion density in the area of the ion chamber adjacent to the modulation channel. When ions are entrained for movement through the modulation channel, the increased ion density in the area adjacent to modulation channel increases the effective corona current output of the printing head without requiring increased airflow or displacement of the coronode from the optimum corona producing location.

In accordance with another aspect of the invention, in an ionographic device as defined above, the head regions are selectively biased along the desired path of ions through the ion chamber so that ions flowing from the coronode pass through successively lower voltages from the coronode to the modulation channel.

In accordance with yet another aspect of the invention, in an ionographic device projecting a modulated stream of ions in imagewise fashion towards a moving imaging surface, including an ion printing head having an ion chamber supporting a coronode held at a voltage $V_C$ to produce ions for deposit on an imaging surface and a modulation channel extending from the ion chamber towards the imaging surface through which a stream of ions is directed for imagewise modulation by a plurality of modulation electrodes, electric field distribution within the ion chamber is controlled by selective placement of dielectric materials on interior walls of the ion chamber, whereby the dielectric material acts as a capacitor to hold a charge and voltage. The voltage on the dielectric material, controllable by the thickness and dielectric constant of the material, focuses the electric field towards the modulation channel.

In accordance with still another aspect of the invention, the electric field within the head is controlled in magnitude and direction so as to direct the greatest amount of ions to the area through which fluid flow to the modulation channel occurs.

The electric field within the ion chamber is geometrically distorted by the varying voltages at the ion chamber walls, the voltages selected to cause focusing of the electric fields within the ionization chamber near the modulation channel, in order to guide ions through the modulation channel. Normally, the entire head is held at a single potential $V_H$ while the coronode is at a relatively high voltage with respect thereto. Electric fields in such a configuration are directed radially outward from the coronode. With the exception of the ions that are directed by the electric field towards the modulation channel, a large proportion of the ions are directed to the head surface. According to this invention, by creating a voltage differential at the ion chamber walls, the effect is to distort the path of the ions towards the modulation channel. Higher ion density occurs at the ion output.

These and other aspects of the invention will become apparent from the following description used to illustrate a preferred embodiment of the invention read in conjunction with the accompanying drawings in which:

FIG. 1 schematically shows an ionographic imaging head of the type contemplated for use with the present invention, in printing relationship with an imaging surface;

Figure 1:
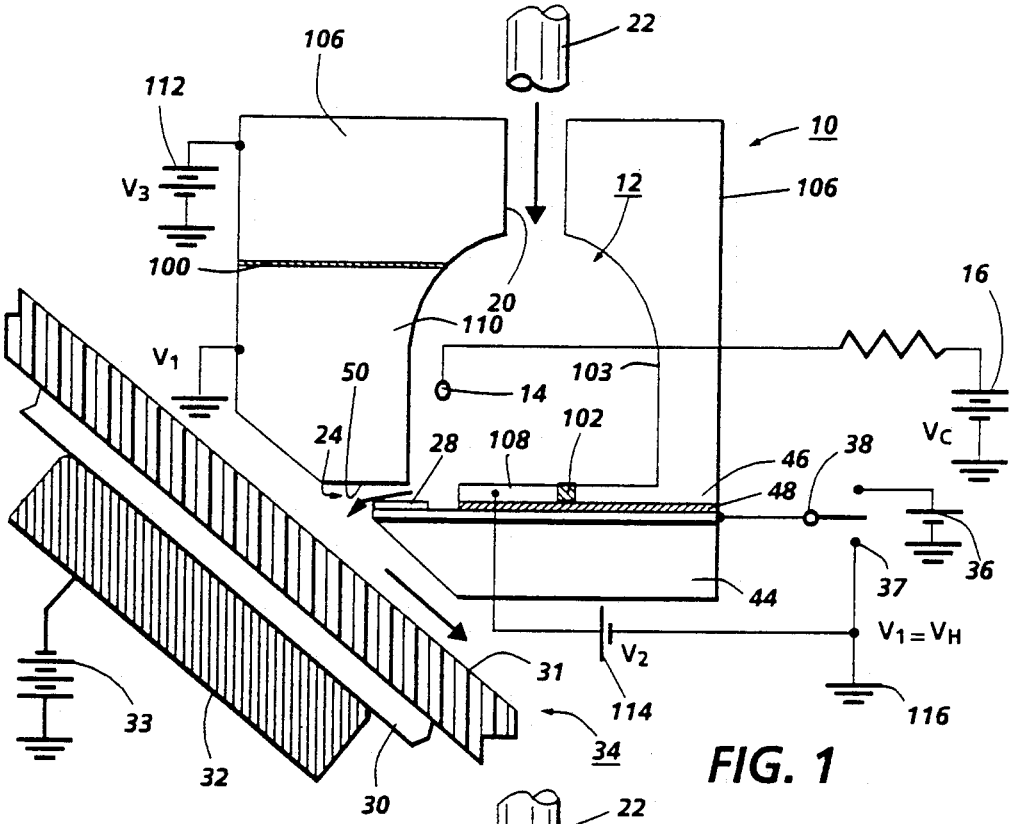

With reference now to the drawings where the showings are for the purpose of illustrating an embodiment of the invention and not for limiting same, FIG. 1 shows a schematic representation of a cross section of the marking head 10 of a fluid jet assisted ionographic imaging apparatus similar to that described in commonly assigned U.S. Pat. No. 4,644,373 to Sheridon et al.

Head 10 includes an ion generation region with an ion chamber 12 formed by the interior surfaces of the head, a coronode 14 supported within the chamber, and a high potential source 16, on the order of several thousand volts D.C., applied to the coronode 14. The head itself will be biased, as explained hereinbelow. The corona discharge around coronode 14 creates a source of ions of a given polarity (preferably positive), which is attracted to the chamber wall and fills the chamber with a space charge.

An inlet channel 20 to ion chamber 12 delivers pressurized transport fluid (preferably air) into chamber 12 from a suitable source, schematically illustrated by tube 22. A modulation channel 24 conducts the transport fluid out of the chamber from ion chamber 12 to the exterior of the head 10. As the transport fluid passes through the chamber 12, it entrains ions and moves them into modulation channel 24, past modulation electrodes 28.

Ions allowed to pass out of head 10, through modulation channel 24 and directed to charge receptor 34, come under the influence of a ground plane 30, provided as a backing layer to a charge receptor dielectric surface 31, with ground plane 30 slidingly connected via a shoe 32 to a voltage supply 33. Alternatively, a single layer dielectric charge receptor might be provided, passing a biased back electrode, to the same effect. Subsequently the latent image charge pattern may be made visible by suitable development apparatus (not shown).

Once ions have been swept into modulation channel 24 by the transport fluid, it becomes necessary to render the ion-laden fluid stream intelligible. This is accomplished by individually switching modulation electrodes 28 in modulation channel 24, between a marking voltage source 36 and a reference potential 37 by means of a switch 38. While the switching arrangement shown produces a binary imaging function, grey levels may be provided by providing a continuously variable voltage signal to the modulation electrodes. The modulation electrodes are arranged on a thin film layer 40 supported on a planar insulating substrate 44 between the substrate and a conductive member 46, and insulated from the conductive plate by an insulating layer 48.

Modulation electrodes 28 and the opposite wall 50, held at $V_H$, comprise a capacitor, across which the voltage potential of source 36, may be applied, when connected through switch 38. Thus, an electric field, extending in a direction transverse to the direction of the transport fluid flow, is selectively established between a given modulation electrode 28 and the opposite wall 50.

"Writing" of a selected spot is accomplished by connecting a modulation electrode to the reference potential source 37, held at $V_H$, so that the ion "beam", passing between the electrode and its opposite wall, will not be under the influence of a field therebetween and transport fluid exiting from the ion projector, in that "beam" zone, will carry the "writing" ions to accumulate on the desired spot of the image receptor sheet. Conversely, no "writing" will be effected when the modulation voltage is applied to an electrode. This is accomplished by connecting the modulation electrode 28 to the low voltage potential of source 36 via switch 38 so as to impose upon the electrode a charge of the same sign as the ionic species. The ion "beam" will be repelled and be driven into contact with the opposite, conductive wall 50 where the ions neutralize into unchanged, or neutral air molecules. Thus, an imagewise pattern of information is formed by selectively controlling each of the modulation electrodes on the marking array so that the ion "beams" associated therewith either exit or are inhibited from exiting the housing, as desired.

As an alternative to an ionographic printing head with fluid jet assisted ion flow, it will no doubt be appreciated that other ionographic print heads may be provided where the ion stream could be field directed to the charge receptor. Further, while the description herein assumes positive ions, appropriate polarity changes may be made so that negative ions may be used.

In accordance with the invention, insulators 100 and 102 are arranged through the print head 10, to separate the conductive interior surface 103 into insulated conductive regions 106, 108 and 110. Voltages $V_3$, $V_2$ and $V_1$, respectively, are connected to regions 106, 108 and 110 to bias the ion head segments such that $V_3 > V_2 > V_1$. A desirable value of $V_3$ might be expected to be less than the coronode voltage, while values for $V_1$ might be expected to approach a system reference voltage. In one modeled example, the following voltages were calculated to give the desired outcome:

$V_3 = 1000$ volts
$V_2 = 100$ volts
$V_1 = 0$ volts
$V_C = 2400$ volts

The spacings or positioning of insulators 100, 102 is selected based on optimization of the electric field distribution, although manufacturability is a concern. The spacing may be more frequent or irregular. Power supplies 112, 114, 116 apply voltages $V_3$, $V_2$ and $V_1$, respectively, to regions 106, 108 and 110. Voltage supply 116 may be a ground or reference voltage.

Figure 2:
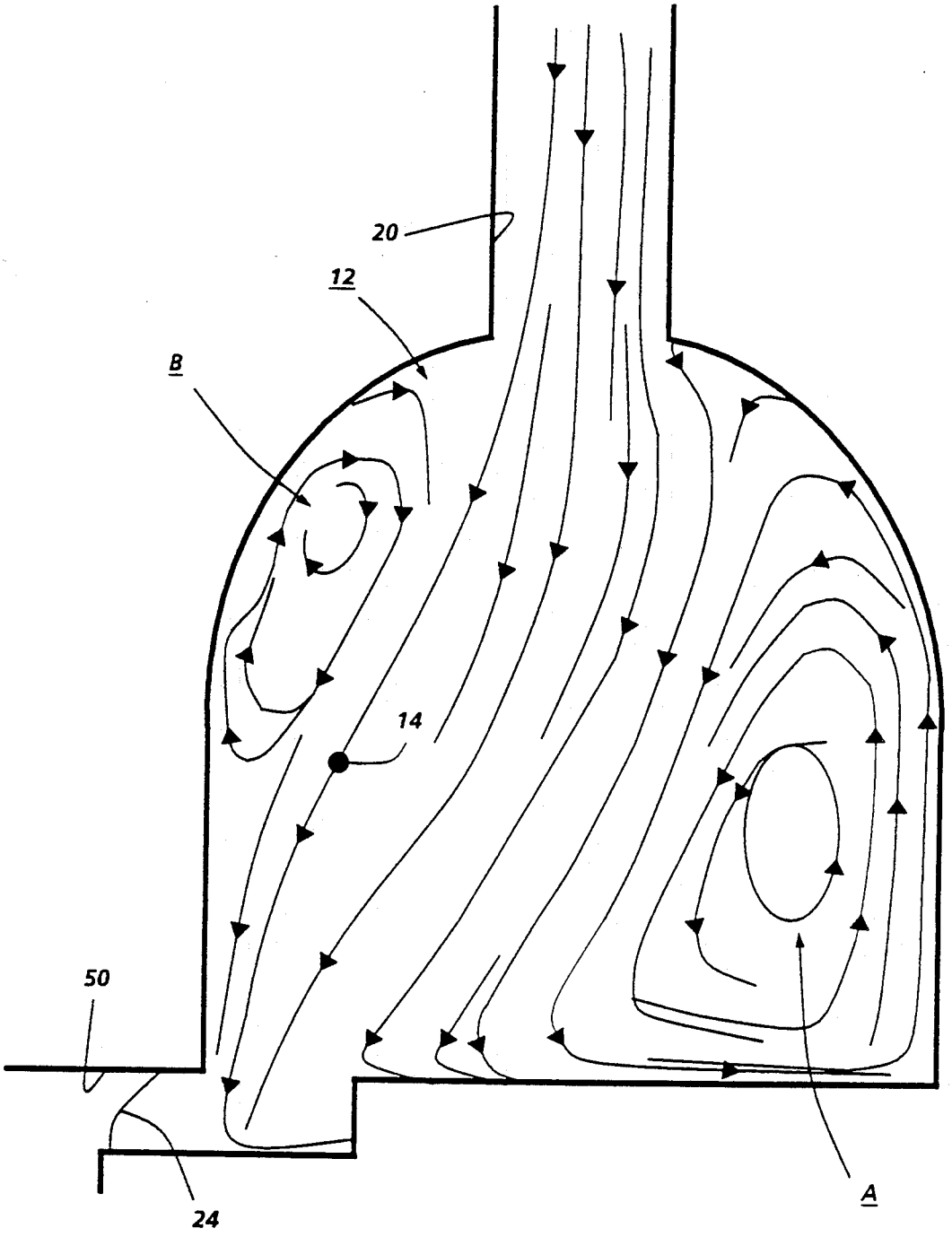
FIG. 2 shows the airflow patterns through a fluid jet assisted ionographic printing head.

FIG. 2 gives an approximation of the airflow patterns within a head 10 as described. It can be seen that air flow entering head 10 through inlet 20 to ion chamber 12 tends to follow a path through a central portion of the chamber, more or less past coronode 14 to modulation channel 24. It will be noted that a pair of vortices labeled A and B tend to form in the chamber portions outside this path. Ions produced to coronode 14, and directed out from the coronode in parallel to the air flow path are more likely to be entrained by the airflow and directed to modulation channel 24 than ions directed towards vortices A and B and entrained in the vortex airflow. If a larger proportion of ions produced at coronode 14 are directed parallel the path of air flow through the head, a greater output of ions will be produced. It will no doubt be appreciated that in a field driven device, where air flow is limited or not provided, the provision of ions directed towards a modulation region is similarly desirable.

Figure 3A:
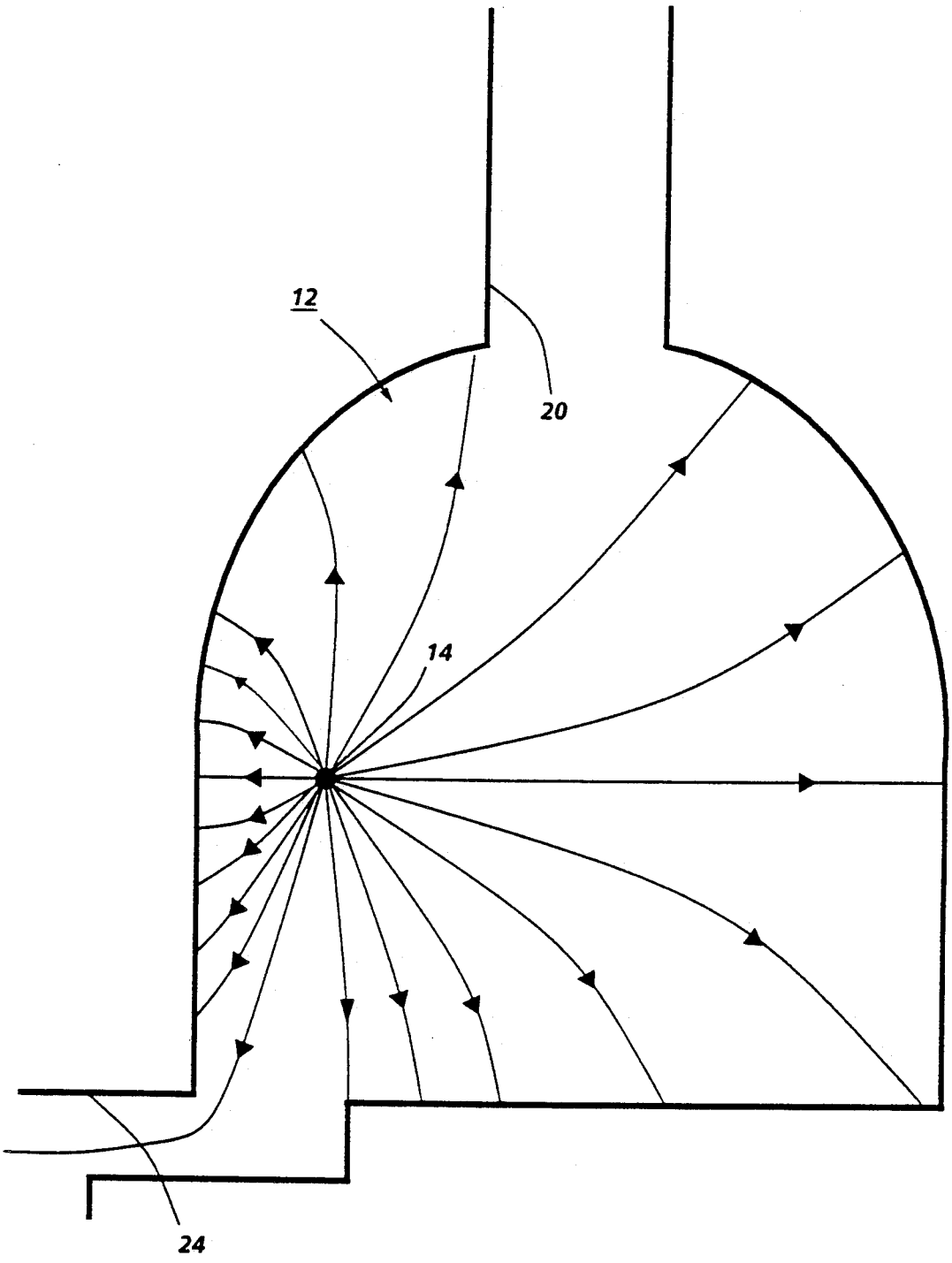
FIGS. 3A and 3B show, respectively, the electric field distribution in a standard ionographic printing head and in a printing head in accordance with the invention.
Figure 3B:
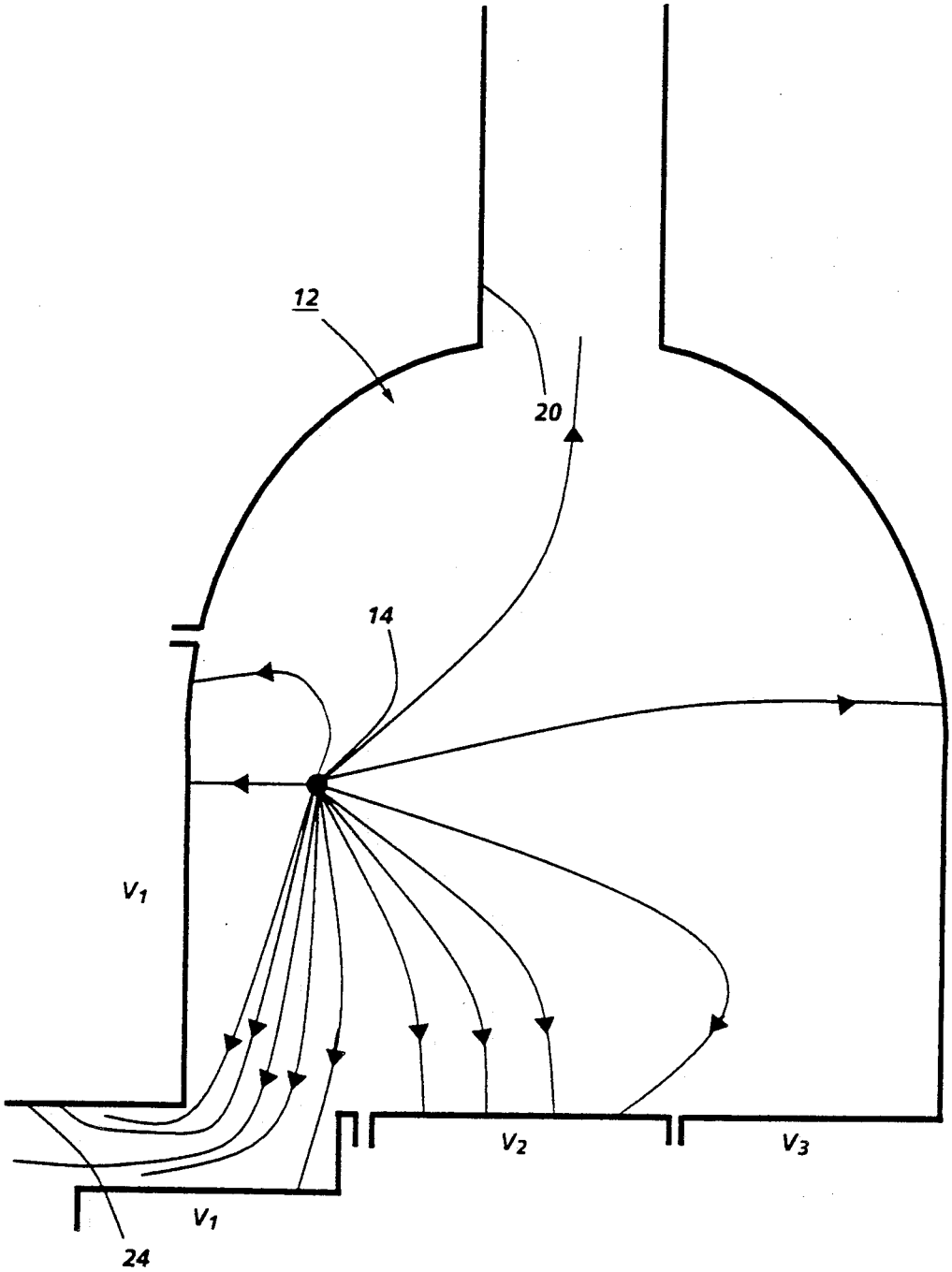

FIGS. 3A and 3B schematically illustrate the approximate electric field distribution in a pair of ionographic heads, with the head uniformly biased, and with the head differentially biased, respectively. In FIG. 3A, it will be noted that the electric field extends approximately radially outwardly from coronode 14 towards the walls of ion chamber 12. Ions tend to flow in the direction of the electric field, and thus a large proportion of ions produced are directed into the wall of the ion chamber. In FIG. 3B, the electric field distribution is shown in a head segmented into a plurality of regions, each region held at voltages $V_3$, $V_2$ and $V_1$ with decreasing values as the segments approach the modulation channel. It can be seen that the electric field is shaped to have a greater magnitude in the direction of the modulation channel. Ions thus tend to flow towards the modulation region, in the direction of the air flow and are more easily entrained and directed by the air flow in that direction. As noted, a variety of segmentation arrangements may be selected to optimize the electric field distribution within any particular device.

Figure 4:
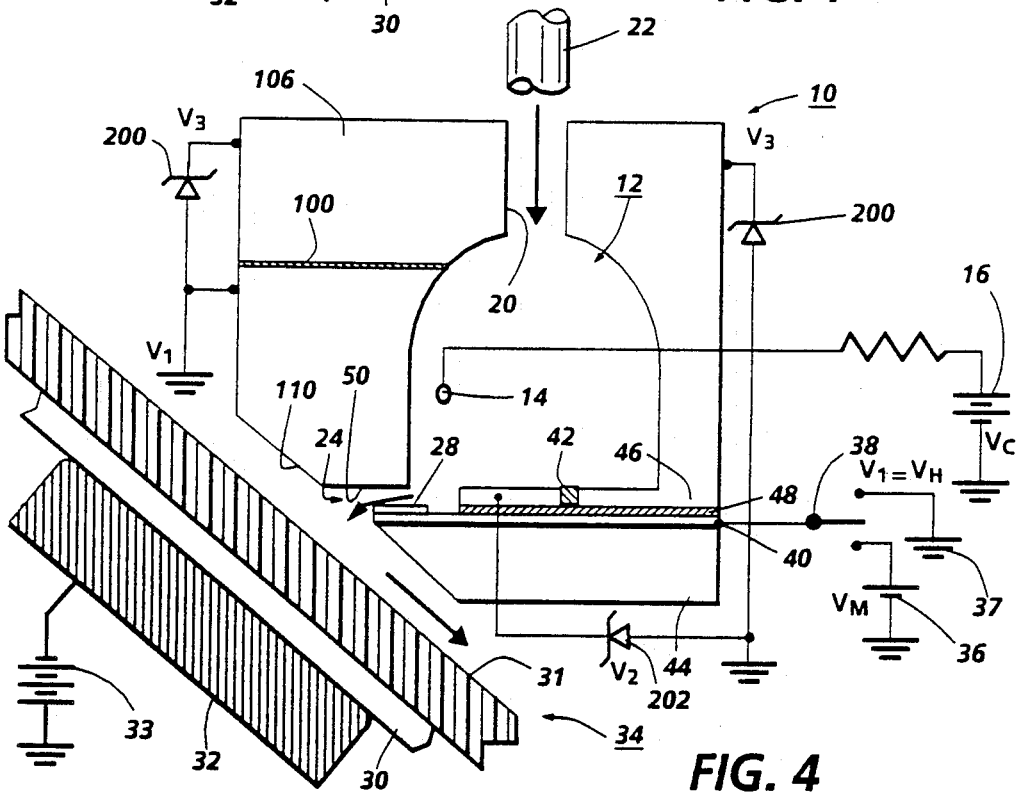
FIG. 4 shows a biasing arrangement for use in association with the invention.

While FIG. 1 shows each of the head regions 106, 108 and 110 connected to separate voltage supplies, FIG. 4, demonstrates a self-biasing arrangement as a relatively low cost alternative. Accordingly, each of head regions 106, 108 and 110 are connected to a reference voltage through a series arrangement of high impedance devices, such as zener diodes 200, 202. The zener diodes with impedance values to provide the appropriate voltage drop between each of the head regions so that each region 106, 108 and 110 is respectively biased at voltages $V_3$, $V_2$ and $V_1$. Of course, combinations of multiple zener diodes may be used, as may variable impedance devices, and combinations of variable and fixed impedance devices.

Figure 5:
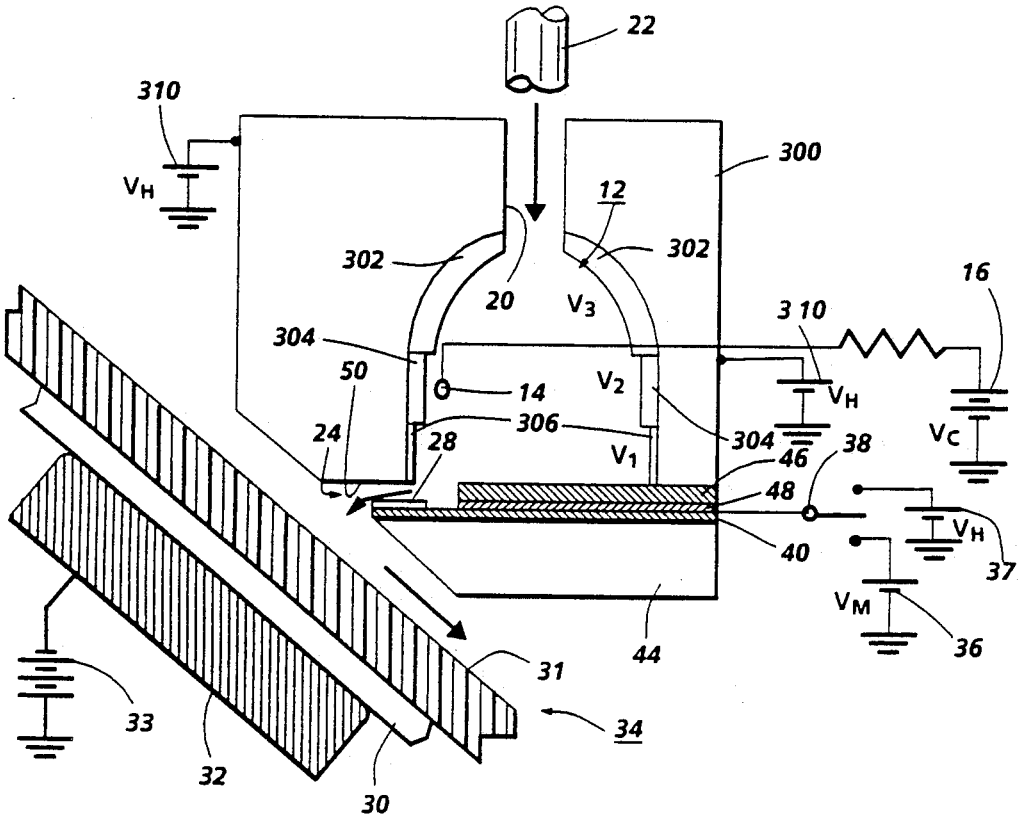
FIG. 5 shows another embodiment of the invention with dielectric covered surfaces in an ionographic printing head.

In accordance with another aspect of the invention, as shown in FIG. 5, another method of providing a voltage gradient within the ion chamber would be to apply dielectric materials to the interior walls of the ion head forming the ion chamber. A dielectric having a dielectric constant K acts as a capacitor, and, upon charging with a device such as coronode 14, obtains a voltage $V_n$, dependent on the thickness t of the dielectric. As shown in FIG. 5, in an unsegmented head 300, where the head is held at a single voltage $V_H$ and otherwise similar to that previously described, the interior walls forming ion chamber 12 are covered with dielectric material layers 302, 304, 306, such as, for example, Kapton or another suitable material, having thicknesses a, b, and c, respectively, where $a > b > c$, and a dielectric constant K acts as a capacitor, to defined voltage regions, where each region is charged to a voltage $V_3$, $V_2$ and $V_1$. In such an arrangement, head 300 might be held at a common voltage $V_H$, supplied by a power supply 310, as in a standard head design. It is possible to provide a continuous surface varying in thickness to provide a continuous voltage gradient instead of discrete voltage levels.

In possible variations of the described arrangement, dielectric material layers 306 might be avoided, if head 300 is held at a voltage level $V_H$ that will provide the electric field appropriate for the layer that is not present. Thus, for example, if $V_H$ is held at a relatively low voltage with respect to the coronode, perhaps at a device reference voltage, there may be no need for dielectric material layer 306. It will no doubt be appreciated that combinations of the above arrangements may also be possible, so that a biased head region, insulated from the rest of the head, may be substituted for any one of the dielectric material layers. Such arrangements may have desirable manufacturing implications.

In addition to the above, which provide discrete voltage regions, it may also be possible to provide a resistive material layer within the head, biased so that a continuous voltage gradient is provided through the head along the ion chamber surfaces. In such an embodiment, the print head body is desirably insulative.

The invention has been described with reference to a preferred embodiment. Obviously modifications will occur to others upon reading and understanding the specification taken together with the drawings. Various alternatives, modifications, variations or improvements may be made by those skilled in the art from this teaching which are intended to be encompassed by the following claims.

We claim:

1. In an ionographic imaging device including an ionographic head for depositing an image pattern of ions on an imaging surface, the ionographic head including an ion source held within an ion chamber formed in the head, a modulation channel extending generally from the ion chamber towards the imaging surface, through which ions pass in a stream for imagewise modulation prior to deposit on the imaging surface, and means for enhancing the efficiency of said ion source to increase the proportion of ions generated at the ion source that are directed through said modulation channel, said enhancing means comprising:

means for segmenting the head into a plurality of head regions, each region forming a portion of the ion chamber;

means for providing a voltage potential on each region, the voltage on each region selected so that the magnitude of an electric field extending outwardly from the ion source within the ion chamber is greatest in the direction of the modulation channel.

2. The device as defined in claim 1 wherein the head segmenting means includes insulating material layers separating each ion head region from the others.

3. The device as defined in claim 1 wherein the head regions are each individually driven with a power supply to provide a voltage at said region.

4. The device as defined in claim 1 wherein said head regions are self biased with respect to a reference voltage, with at least one passive impedance device chosen to maintain the selected voltage at each head region.

5. In an ionographic imaging device including an ionographic head for depositing an image pattern of ions on an imaging surface, the head having an interior surfaces shaped to provide a generally enclosed ion chamber in which an ion source is supported, and a modulation channel extending generally from said ion chamber towards the imaging surface through which ions pass in a stream for imagewise modulation prior to deposit on the imaging surface, and means for enhancing the efficiency of said ion source to increase the proportion of ions generated at the ion source that are directed through said modulation channel, said enhancing means comprising:

means for maintaining differential voltage potentials on areas of the interior surface defining the ion chamber;

means for providing a voltage potential on each surface area to be provided with a voltage potential, the voltage on each surface area selected so that the magnitude of an electric field between the ion source within the ion chamber and the interior surface of the ion head forming the ion chamber is greatest in the direction of the modulation channel; and each of said surface areas are covered with a dielectric material layer having a selected capacitance, whereby upon charging, the selected voltage is maintained.

6. The device as defined in claim 5 wherein said differential voltage providing means includes insulating material layers insulating surface areas of the ion chamber surface from adjacent surface areas.

7. In an ionographic imaging device, including a body having an interior surface defining an ion chamber with an entrance opening and an exit opening and supporting an ion source therewithin, fluid jet means for creating a fluid flow through the entrance opening into the ion chamber and out the exit opening to entrain and carry ions produced at the ion source to an imaging surface moving in a process direction, modulation means at the exit opening to modulate the stream of ions moving therepast to the imaging surface in imagewise fashion, and means for enhancing the efficiency of said ion source to increase the proportion of ions generated at the ion source that are directed through said modulation channel, said enhancing means comprising:

means for segmenting the head into a plurality of head regions, each region forming a portion of the ion chamber;

means for providing a voltage potential on each region, the voltage on each region selected so that the magnitude of an electric field extending outwardly from the ion source within the ion chamber is greatest in the direction of the modulation channel.

8. The device as defined in claim 7 wherein the head segmenting means includes insulating material layers separating each ion head region from adjacent head regions.

9. The device as defined in claim 7 wherein the head regions are each individually driven with a power supply to provide a voltage at said region.

10. The device as defined in claim 7 wherein said head regions are self biased with respect to a reference voltage, with at least one passive impedance device chosen to maintain the selected voltage at each head region.

11. In an ionographic imaging device, including a body having an interior surface defining an ion chamber with an entrance opening and an exit opening and supporting an ion source therewithin, fluid jet means for creating a fluid flow through the entrance opening into the ion chamber and out the exit opening to entrain and carry ions produced at the ion source to an imaging surface moving in a process direction, modulation means at the exit opening to modulate the stream of ions moving therepast to the imaging surface in imagewise fashion, and means for enhancing the efficiency of said ion source to increase the proportion of ions generated at the ion source that are directed through said modulation channel, said enhancing means comprising:

means for maintaining differential voltage potentials on areas of the interior surface defining the ion chamber;

means for providing a voltage potential on each surface area to be provided with a voltage potential, the voltage on each surface area selected so that the magnitude of an electric field between the ion source within the ion chamber and the interior surface of the ion head forming the ion chamber is greatest in the direction of the modulation channel.

12. The device as defined in claim 11 wherein said differential voltage providing means includes insulating material layers insulating surface areas of the ion chamber surface from adjacent surface areas.

13. The device as defined in claim 11 wherein said surface areas each individually driven to a selected differential voltage with a power supply electrically connected to each surface area.

14. The device as defined in claim 11 wherein said surfaces areas are self biased with respect to a reference with at least one passive impedance device chosen to maintain said selected voltage at each surface area.

15. In an ionographic imaging device, including a body having an interior surface defining an ion chamber with an entrance opening and an exit opening and supporting an ion source therewithin, fluid jet means for creating a fluid flow through the entrance opening into the ion chamber and out the exit opening to entrain and carry ions produced at the ion source to an imaging surface, modulation means at the exit opening to modulate the stream of ions moving therepast to the imaging surface in imagewise fashion, and means for enhancing the efficiency of said ion source to increase the proportion of ions generated at the ion source that are directed through said modulation channel, said enhancing means comprising means for maintaining differential voltage potentials on areas of the interior surface defining the ion chamber;

means for providing a voltage potential on each surface area to be provided with a voltage potential, the voltage on each surface area selected so that the magnitude of an electric field between the ion source within the ion chamber and the interior surface of the ion head forming the ion chamber is greatest in a direction parallel to the fluid flow through the ion chamber.

16. In an ionographic imaging device, including a body having an interior surface defining an ion chamber with an entrance opening and an exit opening and supporting an ion source therewithin, fluid jet means for creating a fluid flow through the entrance opening into the ion chamber and out the exit opening to entrain and carry ions produced at the ion source to an imaging surface, modulation means at the exit opening to modulate the stream of ions moving therepast to the imaging surface in imagewise fashion, and means for enhancing the efficiency of said ion source to increase the proportion of ions generated at the ion source that are directed through said modulation channel, said enhancing means comprising:

means for segmenting the body into a plurality of regions, each region forming a portion of the ion chamber;

means for providing a voltage potential on each region, the voltage on each region selected so that the magnitude of an electric field extending outwardly from the ion source within the ion chamber is greatest in the direction of the modulation channel.

17. A method of enhancing the efficiency of an ion source in an ionographic imaging device, including an ionographic head for depositing an image pattern of ions on an imaging surface, said head supporting the ion source within an ion chamber formed in the head, defined by an interior surface thereof, and provided with a modulation channel extending generally from the ion chamber towards the imaging surface, through which ions pass in a stream for imagewise modulation prior to deposit on the imaging surface, including the steps of:

generating ions for imaging, said ions directed generally radially outwardly from the ion source;

providing a voltage differential through said ion chamber, on the head surfaces defining said chamber, to provide an electric field from said ion source to said head having a maximum magnitude in the direction of the modulation channel; and providing a fluid stream through the ion chamber, in a flow direction generally parallel to the direction of the maximum electric field magnitude.

18. The device as defined in claim 17 including means for directing a fluid stream through the ion chamber, in the direction of the maximum electric field magnitude.

19. In an ionographic imaging device, including an ionographic head for depositing an image pattern of ions on an imaging surface, said head supporting the ion source within an ion chamber defined by an interior surface of the head and provided with a modulation channel extending generally from the ion chamber towards the imaging surface, through which ions pass in a stream for imagewise modulation prior to deposit on the imaging surface, and means for enhancing the efficiency of said ion source to increase the proportion of ions directed through said modulation channel, said enhancing means comprising:

means for providing a voltage differential along said interior surface of the ion chamber of the ionographic head, to provide an electric field from said ion source to said head having a maximum magnitude in the direction of the modulation channel.

* * * * *